United States Patent [19]

Kubota

[11] 4,426,127

[45] Jan. 17, 1984

[54] COAXIAL CONNECTOR ASSEMBLY

[75] Inventor: James Kubota, Amherst, N.H.

[73] Assignee: Omni Spectra, Inc., Merrimack, N.H.

[21] Appl. No.: 324,113

[22] Filed: Nov. 23, 1981

[51] Int. Cl.[3] ..... H01R 17/18

[52] U.S. Cl. ..... 339/177 R; 339/252 R; 339/256 RT; 339/DIG. 3

[58] Field of Search ..... 339/177 R, 177 E, 89 C, 339/90 C, DIG. 3, 256 R, 252 R, 258 R, 258 RR, 259 R, 255 R, 255 RT, 256 RT

[56] References Cited

U.S. PATENT DOCUMENTS

| | | | |
|---|---|---|---|
| 1,321,934 | 11/1919 | Merchant . | |
| 2,762,025 | 9/1956 | Melcher | 339/143 |
| 3,678,445 | 7/1972 | Brancaleone | 339/143 R |
| 3,678,451 | 7/1972 | Boliver | 339/258 R |
| 3,792,419 | 2/1974 | Spinner | 339/117 R |
| 3,871,735 | 3/1975 | Herrmann | 339/117 R |
| 4,072,392 | 2/1978 | McConnell et al. | 339/258 R |
| 4,106,839 | 8/1978 | Cooper | 339/143 R |
| 4,128,293 | 12/1978 | Paoli | 339/258 R |
| 4,248,492 | 2/1981 | Snyder | 339/89 M |
| 4,278,317 | 7/1981 | Gallussner et al. | 339/258 R |
| 4,326,768 | 4/1982 | Punako | 339/143 R |

*Primary Examiner*—Eugene F. Desmond
*Assistant Examiner*—David L. Pirlot
*Attorney, Agent, or Firm*—Hayes, Davis & Soloway

[57] ABSTRACT

A coaxial connector comprising a male half of conventional construction and a female half having an annular electrical contact member which is a spring and which functions to provide continuous annular outer conductor electrical contact and RFI suppression. The annular spring member provides continuous annular outer conductor contact even during slight conductor misalignment or matched pairs not totally seated.

11 Claims, 17 Drawing Figures

COAXIAL CONNECTOR ASSEMBLY

The present invention relates to electrical connector assemblies, and more particularly, to quick connect/disconnect connector assemblies for electrically coupling two components or modules together or to gain access to a certain point in an electronic circuit assembly. The invention has particular application as so-called "pluggable connectors" for coaxial transmission lines, and will be described in connection with such application. It will be understood, however, that the quick connect-/disconnect connector assembly of the present invention may be employed in other electronic environments such as for electrically coupling racks and panels, back planes, component modules to mother boards, component module to component module or other electronic systems packaging.

A principal requirement for a pluggable electrical connector assembly is to provide a convenient connection means which effects an acceptably low disturbance of the electrical signals being transmitted or carried between the coupled components. Typically, electrical connector assembly performance characteristics can heavily influence total electrical systems performance. Quick disconnects permit rapid access for maintenance or repair functions. Accordingly, the art has directed much attention to the design of electrical connector assemblies.

It is an object of the present invention to provide an improved quick connect/disconnect electrical connector assembly characterized by low signal disturbance and/or signal attenuation. Another object of the present invention is to provide an improved quick connect/disconnect electrical connector assembly of the foregoing type and characterized by low engagement/disengagement forces.

Briefly described, the present invention provides a novel pluggable connector assembly for electrically coupling two ends of a coaxial circuit configuration, each characterized by an inner conductor positioned within an outer conductive shield surrounding the inner conductor, and comprising a male connector assembly and a mating female connector assembly. The male connector assembly is of conventional construction and typically comprises a male plug assembly in the form of an electrically conductive inner conduct pin member for electrical connection to a coaxial circuit inner conductor, and an electrically conductive outer conductor member, electrically isolated from and surrounding the electrically conductive inner conductor pin member, in part, for electrical connection to the coaxial circuit outer conductor/shield. The female connector assembly comprises a female receptacle assembly having a bore of generally complementary profile for accommodating the male plug assembly, and including an electrically conductive inner conductive contact assembly for receiving and contacting the male plug assembly inner conductor pin member and for electrical connection to a coaxial circuit inner conductor, and an electrically conductive outer conductor contact member electrically isolated from and surrounding the electrically conductive inner conductor contact assembly, in part, for receiving and contacting the male plug assembly outer conductor member and for electrical connection to a coaxial circuit outer conductor/shield. The female receptacle assembly inner conductor contact assembly comprises an electrically conductive slotted metallic contact member of convention construction, and an electrically conductive metallic hood member surrounding the slotted contact member and electrically connected thereto. In a preferred embodiment of the invention the hood member has a generally inwardly directed integral annular flange portion which provides continuous, i.e. circumferential (360°) substantially constant diameter continuation of mated inner conductors. The female receptacle assembly outer contact member comprises an electrically conductive spring contact member having a generally outwardly flared integral slotted flange portion at one end thereof, and a generally inwardly flared slotted flange portion at the other end thereof. The female receptacle assembly outer contact member is dimensioned and shaped so as to completely surround the plug member outer contact, i.e provide continuous (360°) substantially constant diameter continuation of mated outer contacts, while at the same time provide very low engagement/disengagement forces whereby to permit convenient connection and disconnection of the male and female connector assemblies.

Still other features and many of the attendant advantages of the invention are set forth or rendered obvious by the following detailed description which is to be considered together with the accompanying drawings wherein like numbers denote similar parts, and wherein FIG. 1 is a side elevational view in cross-section of an electrical connector assembly made in accordance with the present invention and showing a male plug assembly mated with a female receptacle assembly;

Figure 1:
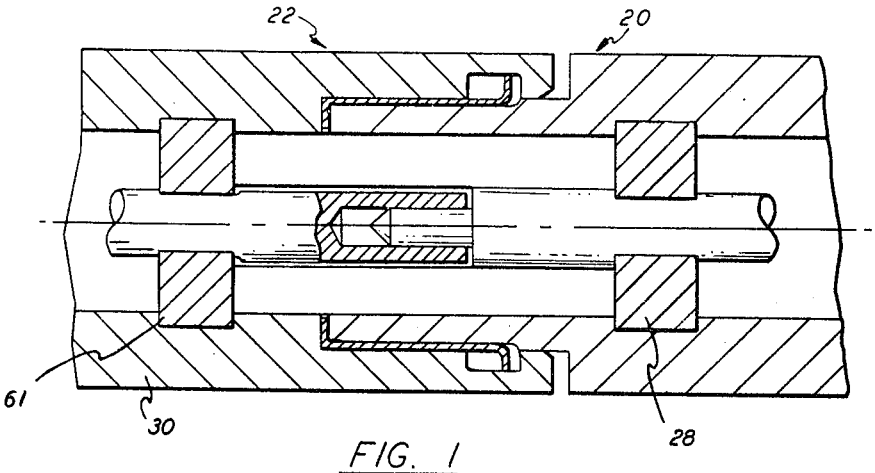
Figure 6A:
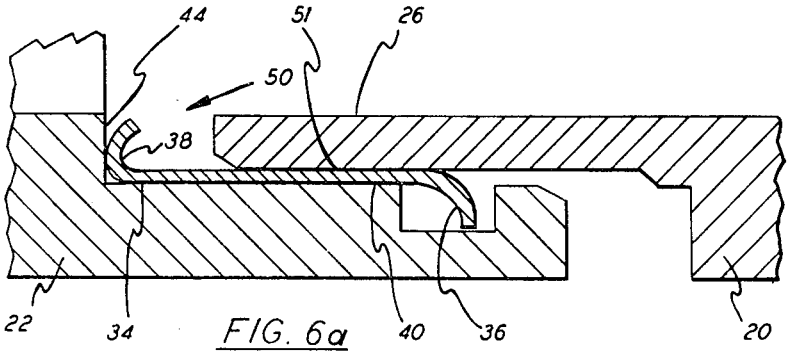
Figure 6B:
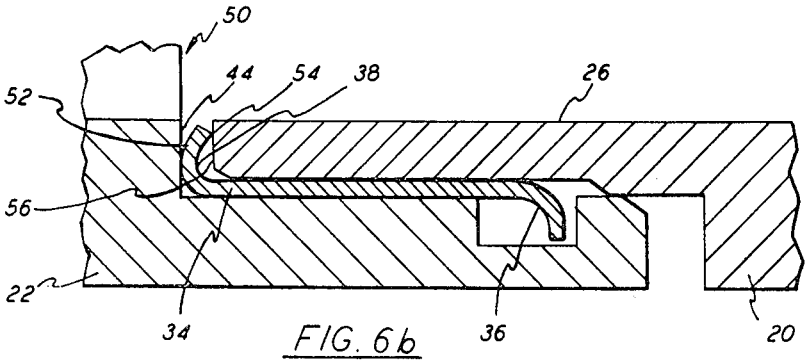
Figure 6C:
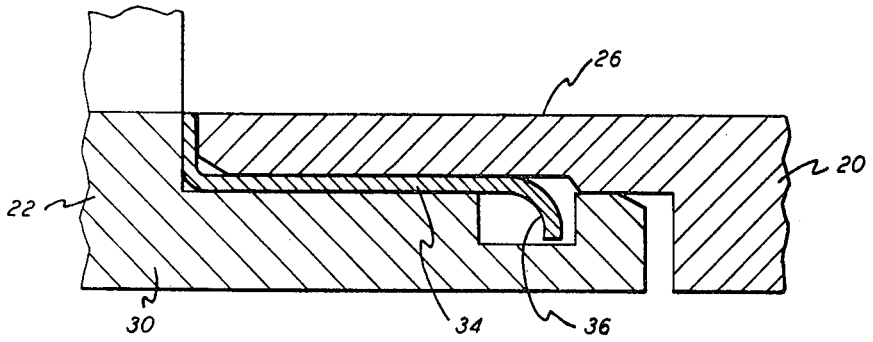
Figure 7:
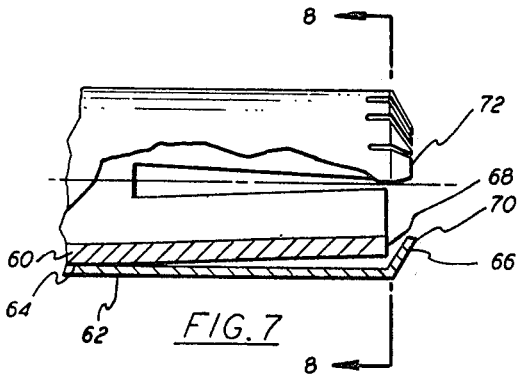
Figure 8:
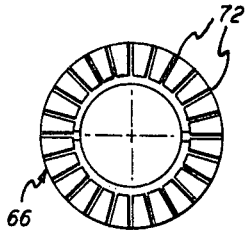
Figure 9A:
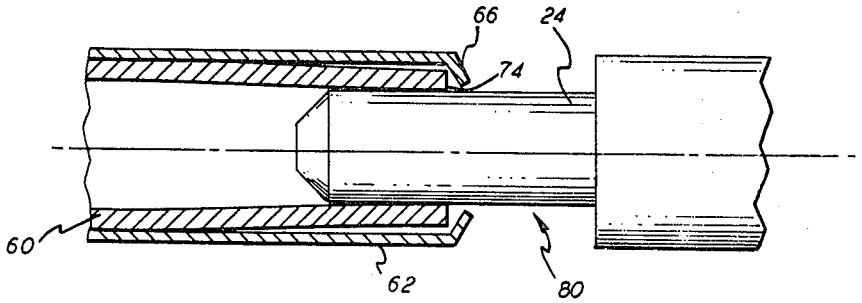
Figure 9B:
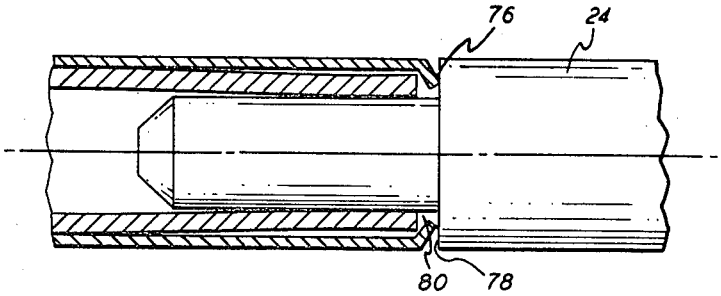
Figure 9C:
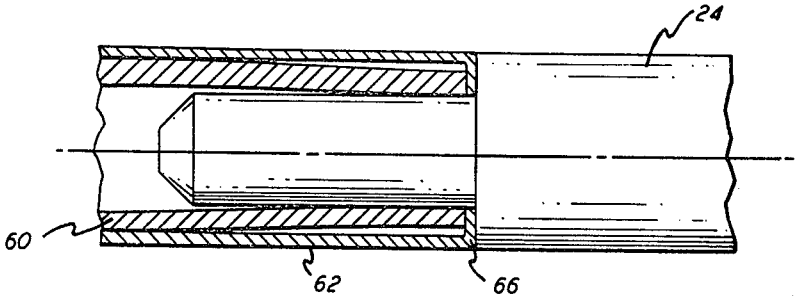
Figure 10:
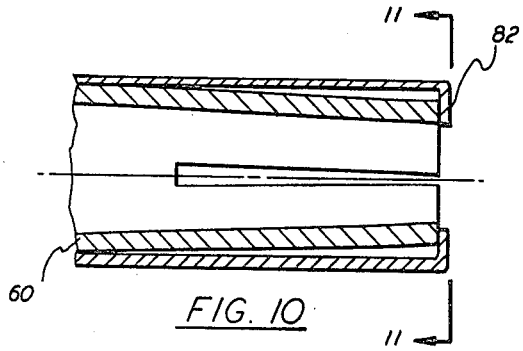
Figure 11:
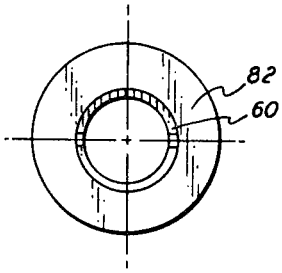
Figure 12:
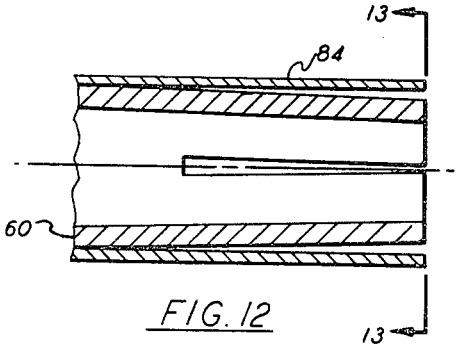
Figure 13:
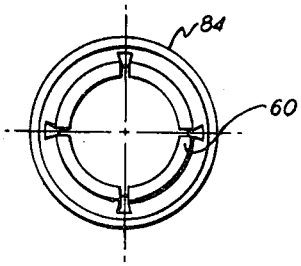

FIG. 6*a* is an enlarged elevational view in cross-section, and showing details of the contacting members of the connector assembly of FIG. 1 with the male plug assembly and female receptacle assembly marginally engaged;

FIG. 6*b* is a view similar to FIG. 6*a*, but showing the male plug assembly and female receptacle assembly normally engaged;

FIG. 6*c* is a view similar to FIG. 6*a*, but showing the male plug assembly and female receptacle assembly fully engaged;

FIG. 7 is an enlarged side elevational view, partly in cross-section, and showing details the inner conductor contact assembly the female receptacle assembly of FIG. 1;

FIG. 8 is an end view of the structure of FIG. 7, taken along the plane of 7—7;

FIG. 9*a* is an enlarged elevational view in cross-section, and showing details of the inner conductors of FIG. 1 with the male plug assembly and female receptacle assembly marginally engaged;

FIG. 9*b* is a view similar to FIG. 9*a*, but showing the male plug assembly and female receptacle assembly normally engaged;

FIG. 9*c* is a view similar to FIG. 9*a*, but showing the male plug assembly and female receptacle assembly fully engaged;

FIG. 10 is an enlarged side elevational view in cross-section, and showing details of an alternative construction of female receptacle assembly inner conductor contact assembly in accordance with the present invention;

FIG. 11 is an end view of the structure of FIG. 10, taken along the plane of 10—10;

FIG. 12 is an enlarged side elevational view in cross-section and showing details of yet another construction of female receptacle assembly inner conductor contact assembly in accordance with the present invention; and FIG. 13 is an end view of the structure of FIG. 12, taken along the plane of 13—13.

Figure 2:
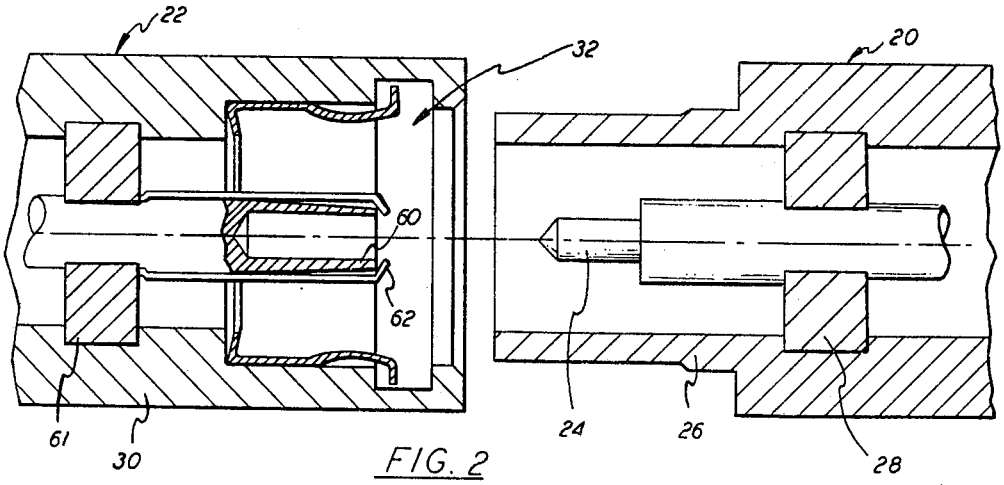
FIG. 2 is a side elevational view in cross-section of the connector assembly of FIG. 1, and showing the male plug assembly disengaged from the female receptacle assembly.

One embodiment of electrical connector assembly made in accordance with the present invention is shown in FIGS. 1 and 2 of the drawings. (For convenience of illustration only a portion of the connector assembly is shown in the drawings.) The connector assembly comprises a male plug assembly 20 and a mating female receptacle assembly 22. Male plug assembly 20 is of conventional construction and comprises an electrically conductive inner conductor pin member 24 of circular cross-section for electrical connection, in known manner, to the inner conductor of a coaxial circuit (not shown), and an electrically conductive outer conductor member 26 of circular cross-section for electrical connection, in known manner to the outer conductor/-shield of a coaxial circuit (not shown). The inner conductor pin member 24 and outer conductor member 26 are electrically isolated from one another by an annular spacer 28 formed of a suitable dielectric material. Although this annular spacer is illustrated as a thin bead, it can completely or partially fill the annular space. Further details of male plug assembly 20 have been omitted as they are not believed necessary for an understanding of the present invention.

Figure 3:
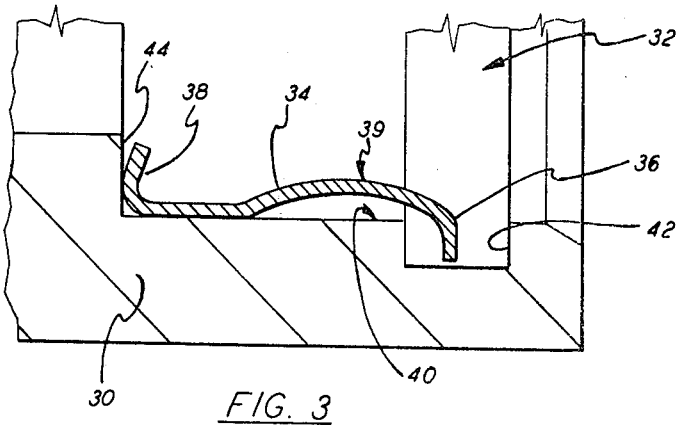
FIG. 3 is an enlarged elevational view in cross-section, and showing certain details of the outer contact member of the female receptacle assembly of FIG. 1.
Figure 4:
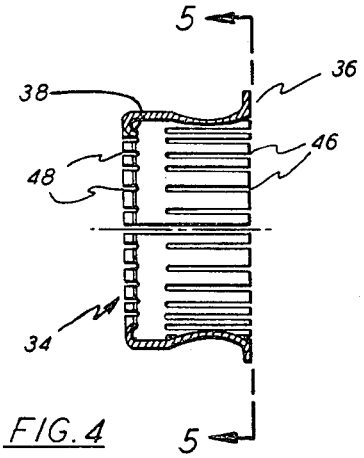
FIG. 4 is an enlarged elevational view in cross-section, and showing still further details of the structure of FIG. 3.
Figure 5:
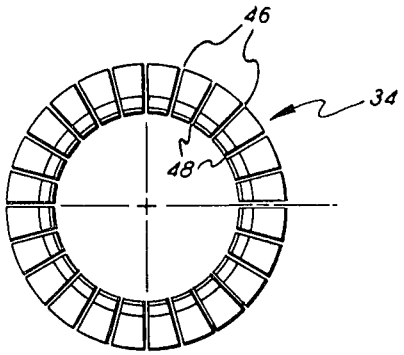
FIG. 5 is an end view of the structure of FIG. 4, taken along the plane 5—5.

Female receptacle assembly 22 comprises a generally cylindrical outer housing member 30 formed of electrically conductive material and having a blind bore or hole 32 of generally complementary profile for accommodating male plug assembly 20. Referring in particular to FIGS. 3 to 5 a resiliently deformable electrical conductive spring contact member 34, made of metal or a conductive elastomer such as metal filled rubber or the like, in the form of a generally short cylindrical body, flared outwardly at one end 36 thereof, and inwardly at its outer end 38, i.e., crown-like shaped, is fitted within housing member 30 with the spring contact member 34 outwardly flared end 36 captured within an annular groove 42 formed in the inner wall surface 40 of housing member 30, and with the spring contact member 34 inwardly flared end 38 adjacent to or seated against an internal end wall 44 of housing member 30. Referring in particular to FIGS. 4 and 5 a plurality of slots 46 and 48 are formed in spring contact member 34 flared ends 36 and 38, respectively, for facilitating shaping of the spring contact member 34 flared ends 36 and 38, and for increasing relative flexibility of the spring contact member 34 for reasons as will become clear from the description following.

Spring member 34 is dimensioned and shaped in general conformity with bore 32, but with a portion 39 of the spring contact member 34 normally displaced in part from contact with the bore internal profile. As will be described in detail hereinafter, upon engagement of the male plug assembly 20 electrically conductive outer conductor member 26 flexible spring contact member 34 flexes outwardly at portion 39 to more closely conform to the receptacle bore interior profile. Spring contact member 34 should also be dimensioned and shaped so as to permit minimum physical interference with but close fit on the male plug assembly 20 outer conductor contact member 26 when the male and female connector assemblies are mated to one another. Tolerances are selected so as to provide desired low engagement/disengagement forces taking into account the relative sizes of the mating members and the coefficient of elasticity of flexible spring contact member 34, while assuring continuous circumferential (360°) electrical contact between the mated parts as will be described in detail hereinbelow.

FIGS. 6*a* to 6*c*, illustrate male plug assembly 20 inserted into female receptacle assembly 22 under varying conditions of mating. For making a connection, male plug assembly 20 is inserted fitted into female receptacle assembly 22. As seen in FIG. 6*a*, spring contact member 34 outwardly flared end 36 permits initial entry of the male plug outer conductor contact member 26. Continued insertion of the male plug assembly causes spring contact member 34 to flex and to eventually lay flat on the female receptacle inner wll surface 40. Continued insertion of the male plug assembly urges the contacting parts surfaces together in wiping engagement so as to clear away any foreign matter on the contacting surfaces and to break through any thin insulating films (oxides) that may have formed on the contacting surfaces.

Referring specifically to FIG. 6*a*, there is illustrated a male plug assembly 20 and female receptacle assembly 22 made in accordance with the present invention just marginally engaged, i.e. with the male and female assemblies unseated by a gap 50. Notwithstanding only relatively marginal engagment of the male and female connectors, it will be seen that minimum electric shielding conditions required for low radio frequency interference and/or electromagnetic interference are satisfied by the existence of substantial mating surfaces 51 between male plug outer conductor contact member 26 and spring contact member 34, and between receptacle inner wall surface 40 and spring contact member 34. In other words, flexible spring contact member 34 provides continuous circumferential (360°) electrical contact between male plug assembly 20 and female receptacle assembly 22 so that radio frequency interference and/or electromagnetic interference is minimized even through the male plug and female receptacle assemblies are not fully engaged.

FIG. 6*b* illustrates the male plug assembly and female receptacle assembly in accordance with the present invention under normal mating engagement. As seen in FIG. 6*b* the male plug and female receptacle assemblies are now sufficiently engaged so that spring contact member 34 can engage wall contact surface 44 of the female receptacle assembly, i.e., at reverse bend 52, while edge surface 54 contacts the leading end surface 56 of male plug assembly outer conductor contact surface 26 thus providing substantially uniform circumferential (360°) contact between male plug assembly 20 and female receptacle assembly 22 at additional points. Additionally spring contact member 34 flared end 38 now partially fills gap 50 so as to further minimize signal disruptions resulting in improved signal transmission efficiency.

FIG. 6*c* illustrates male plug assembly 20 fully seated within female receptacle assembly 22. As seen in FIG. 6*c*, when the male plug assembly 20 is full seated within female receptacle assembly 22 spring contact member 34 is captured between and in substantially continuous electrical contact with the engaged male and female connector assemblies. This results in substantially uniform continuous (360°) maximum electrical contact between male plug assembly 20 outer conductor member 26 and the female receptacle assembly 22 outer member 30 and thus provides an electrically uninterrupted outer conductor shield connect between the mated plug and female receptacle assemblies which improves signal transmission efficiency with minimum RFI/EMI.

FIG. 7 and 8 illustrate certain details of the female connector assembly 22 inner conductor contact assembly construction. Referring to FIGS. 7 and 8 female receptacle assembly 22 inner conductor contact includes a slotted inner socket contact 60 of conventional construction. The latter is electrically isolated from the receptacle assembly 22 outer housing member 30 by an annular spacer 61 (see FIGS. 1 and 2) formed of a suitable dielectric material, and is surrounded by a resiliently flexible generally cylindrical electrically conductive hood member 62 formed of metal or an electrically conductive elastomer. Slotted socket contact 60 and hood member 62 are of close fit and are electrically connected to one another, e.g. along surface 64. An inwardly directed integral flange 66 is formed at the other end of hood member 62. Socket contact 60 and hood member 62 are close fitted axially and are near coincident at their entry ends 68 and 70, and are dimensioned so as to accommodate male plug connector 20 inner conductor pin member 24 (see FIG. 2). As seen particularly in FIG. 8, hood member 62 flange 66 is slotted at 72, the purpose of which is to permit ready flexing of the flange end, the reason for which will become clear from the description following.

FIGS. 9*a* to 9*c* illustrate male plug assembly 20 inner conductor pin member 24 inserted into female receptacle assembly 22 inner conductor contact assembly under varying degrees of mating. As before male plug assembly 20 is inserted into the female plug assembly 22. FIG. 9*a* illustrates male plug assembly 20 and receptacle assembly 22 just marginally engaged. As seen in FIG. 9*a*, inserting inner conductor pin member 24 slightly into socket contact 60, pin member 24 will make solid electrical contact with the leading inner edge surfaces 74 of slotted contact 60, while hood member 62 provides substantially uniform circumferential (360°) electrical surround of the mated inner conductors.

Referring to FIG. 9*b*, inserting male connector assembly 20 further into female receptacle assembly 22 produces electrical contact of leading edge 76 of hood member 62 with pin member 24 at surface 78. Electrical contact between edge 76 and pin surface 78 also is enhanced by the sliding (wiping) action of hood member 62 on pin surface 78. Contacting surfaces 76 and 78 also provide substantially uniform circumferential (360°) electrical contact, and the hood flange 66 fills the gap 80 between the inner conductor members of male plug assembly 20 and female receptacle assembly 22 so as to further minimize signal disruptions.

FIG. 9*c* illustrates optimum inner conductor mating between male plug assembly 20 and female receptacle assembly 22. As seen in FIG. 9*c*, inserting male connector assembly 20 further into female receptacle assembly 22 brings hood member 62 and pin member 24 outer surface in substantial coincidence, completely filling gap 80, and resulting in substantially continuous electrical contact of the inner conductor member of male plug assembly 20 and female receptacle assembly 22.

As should be clear from the foregoing the instant invention provides improved low engagement force quick connect/disconnect (pluggable) connectors. Moreover, connector engagement forces may be readily tailored by suitable selection of materials and member tolerances, i.e., so as to permit multiple connections to be simultaneously engaged or disengaged. If desired, one or both of the mating connectors can be float-mounted to achieve self-alignment for multiple connector matings. Furthermore, the connectors of the present invention provide superior R.F. performance due to continuous circumferential (360°) electrical contact even when the mating connectors are misaligned, or mated pairs not seated totally, i.e., as illustrated in FIGS. 6*a* and 6*b* and 9*a* and 9*b*. The continuous electrical contacts provided by the instant invention result in uniform symmetrical electrical phase front (planar wave) propagating through the mated connector parts, and low RFI (Radio Frequency Interference)-/EMI (Electromagnetic Interference). The resulting minimum electrical disturbance results in greater transmission efficiency and lower VSWR (Voltage Standing Wave Ratio).

Certain changes may be made in the foregoing product without departing from the spirit and scope of invention herein described. For example, male plug assembly 20 and female receptacle assembly 22 and the various mating parts thereof have been described as being of generally circular cross-section; however, they can be of square, rectangular or other suitable mating shapes. Moreover, hood member 62 need not be slotted adjacent its flanged end, but rather may simply comprise a folded over continuous integral flange 82 as shown in FIGS. 10 and 11. Alternatively, flange may be omitted from the hood member so that the hood member simply comprises a cylindrical metallic body 84 as shown in FIGS. 12 and 13. Still other changes will be obvious to one skilled in the art.

I claim:

1. A connector assembly of the pluggable type for electrically coupling two ends of a coaxial circuit configuration including (A) a male plug assembly comprising (1) an electrically conductive inner conductor pin member for electrical connection to a coaxial circuit inner conductor, and (2) an electrically conductive outer conductor member, electrically isolated from and surrounding said electrically conductive pin member in part, and (B) a mating female receptacle assembly having a bore of generally complementary profile for accommodating said male plug assembly, said female receptacle assembly comprising (1) an electrically conductive inner conductor contact member for receiving and contacting said male plug assembly inner conductor pin member, (2) an electrically conductive outer conductor contact member electrically isolated from and surrounding said electrically conductive inner conductor contact assembly in part, for receiving and contacting said male plug assembly outer contact member, said female receptacle assembly outer conductor contact member having a resiliently flexible spring contact member which is (a) normally displaced in part from contact with said receptacle bore interior profile, and which, upon engagement of said male plug assembly electrically conductive outer conductor member (b) flexes outwardly to more closely conform to said receptacle bore interior profile, and which, upon continued insertion of said male plug assembly (c) presses progressively into engagement with said male plug assembly electrically conductive outer conductor member, and (3) an electrically conductive hood member electrically connected to and surrounding, in part, said female receptacle assembly inner conductor contact member, said resiliently flexible spring contact member having a generally outwardly directed integral flange at the male plug engaging end thereof, and a generally inwardly directed integral flange at the other end thereof, and said female receptacle assembly having an annular groove formed therein for accommodating said outwardly directed flange.

2. A connector assembly according to claim 1, wherein said resiliently flexible spring contact member is slotted adjacent its flanged ends thereby forming contact fingers.

3. A connector assembly according to claim 1, wherein said resiliently flexible spring contact member comprises a spring metal.

4. A connector assembly according to claim 1, wherein said electrically conductive hood member has a generally inwardly directed integral flange which terminates near the male plug engaging end of its associated electrically conductive inner conductive contact member.

5. A connector assembly according to claim 1, wherein said electrically conductive hood member comprises a metal.

6. A connector assembly of the pluggable type for electrically coupling two ends of a coaxial circuit configuration including (A) a male plug assembly comprising (1) an electrically conductive inner conductor pin member for electrical connection to a coaxial circuit inner conductor, and (2) an electrically conductive outer conductor member, electrically isolated from and surrounding said electrically conductive pin member in part, and (B) a mating female receptacle assembly having a bore of generally complementary profile for accommodating said male plug assembly, said female receptacle assembly comprising (1) an electrically conductive inner conductor contact member for receiving and contacting said male plug assembly inner conductor pin member, (2) an electrically conductive outer conductor contact member electrically isolated from and surrounding said electrically conductive inner conductor contact assembly in part, for receiving and contacting said male plug assembly outer contact member, said female receptacle assembly outer conductor contact member having a resiliently flexible spring contact member which is (a) normally displaced in part from contact with said receptacle bore interior profile, and which, upon engagement of said male plug assembly electrically conductive outer conductor member (b) flexes outwardly to more closely conform to said receptacle bore interior profile, and which, upon continued insertion of said male plug assembly (c) presses progressively into engagement with said male plug assembly electrically conductive outer conductor member, and (3) an electrically conductive hood member electrically connected to and surrounding, in part, said female receptacle assembly inner conductor contact member, said resiliently flexible spring contact member comprising an electrically conductive elastomer.

7. A connector assembly of the pluggable type for electrically coupling two ends of a coaxial circuit configuration including (A) a male plug assembly comprising (1) an electrically conductive inner conductor pin member for electrical connection to a coaxial circuit inner conductor, and (2) an electrically conductive outer conductor member, electrically isolated from and surrounding said electrically conductive pin member in part, and (B) a mating female receptacle assembly having a bore of generally complementary profile for accommodating said male plug assembly, said female receptacle assembly comprising (1) an electrically conductive inner conductor contact member for receiving and contacting said male plug assembly inner conductor pin member, (2) an electrically conductive outer conductor contact member electrically isolated from and surrounding said electrically conductive inner conductor contact assembly in part, for receiving and contacting said male plug assembly outer contact member, said female receptacle assembly outer conductor contact member having a resiliently flexible spring contact member which is (a) normally displaced in part from contact with said receptacle bore interior profile, and which, upon engagement of said male plug assembly electrically conductive outer conductor member (b) flexes outwardly to more closely conform to said receptacle bore interior profile, and which, upon continued insertion of said male plug assembly (c) presses progressively into engagement with said male plug assembly electrically conductive outer conductor member, and (3) an electrically conductive hood member electrically connected to and surrounding, in part, said female receptacle assembly inner conductor contact member, said electrically conductive hood member being slotted adjacent its flanged end thereby forming contact fingers.

8. A connector assembly according to claim 1, wherein said electrically conductive hood member comprises an electrically conductive elastomer.

9. A connector assembly according to any one of claims 1, 2, 3, 6, 4, 7, 5 or 8, the improvement wherein said mating inner contact members and said mating outer contact members, respectively, are generally circular in cross section.

10. The female half of a coaxial connector for use with a male half, and comprising (1) an electrically conductive circular outer conduit of generally circular cross-section, bored to receive and mating with the male half thereof, (2) an electrically conductive socket therein of generally circular cross-section adapted to receive and mate with an inner conductive generally cylindrical pin centrally disposed in said male half, (3) an electrical insulator supporting said socket within and spaced from said outer conduit but leaving the ends of said socket and outer conduit free, (4) and electrically conductive sheath surrounding and in contact with said socket, in part, and having an outer end adapted to make substantially 360° contact with the cylindrical surface of said cylindrical pin, and (5) a generally cylindrical electrically conductive spring sleeve retained within the bore of said outer conduit and in electrical contact therewith, the walls, of said sleeve being inwardly curved when uncompressed, and dimensioned such that upon the insertion of the male half therein, said sleeve makes substantially 360° contact thereabout, said sleeve having an outwardly directed integral slotted flange at its outer end and an inwardly directed integral slotted flange at its inner end, and said electrically conductive outer circuit having a circumferential groove for accommodating said outwardly directed flange.

11. The female half according to claim 10, wherein said sheath has an inwardly directed integral slotted flange at its outer end.

* * * * *